US005655318A

United States Patent [19]

Daniels

[11] Patent Number: 5,655,318

[45] Date of Patent: Aug. 12, 1997

[54] SNOWPLOW WITH PIVOTABLE BLADE END EXTENSIONS

[76] Inventor: Gregory J. Daniels, 15N365 Old Sutton Rd., East Dundee, Ill. 60118

[21] Appl. No.: 485,464

[22] Filed: Jun. 7, 1995

[51] Int. Cl.[6] ..... E01H 5/04

[52] U.S. Cl. ..... 37/231; 37/236; 37/281; 37/232; 172/815

[58] Field of Search ..... 37/231, 235, 236, 37/274, 281, 403–410, 468, 232, 233, 234; 172/815, 219, 817; 405/151–157, 163

[56] References Cited

U.S. PATENT DOCUMENTS

| | | | |
|---|---|---|---|
| 1,389,118 | 8/1921 | Bergeron | 73/274 X |
| 3,418,734 | 12/1968 | McConnell | 37/407 |
| 3,605,167 | 9/1971 | Martel et al. | 172/815 X |
| 3,720,010 | 3/1973 | Coates | 37/410 X |
| 3,898,753 | 8/1975 | Kinnunen | 172/815 X |
| 4,019,268 | 4/1977 | Waterman | 172/815 X |
| 4,074,448 | 2/1978 | Niemela . | |
| 4,096,652 | 6/1978 | Raines et al. . | |
| 4,099,578 | 7/1978 | Stevens | 172/815 |
| 4,135,583 | 1/1979 | Becker | 172/815 |
| 4,243,356 | 1/1981 | Takojima | 37/403 X |
| 4,249,323 | 2/1981 | Mathis et al. . | |
| 4,275,514 | 6/1981 | Maura . | |
| 4,306,362 | 12/1981 | Waterman . | |
| 4,356,645 | 11/1982 | Hine et al. . | |
| 4,372,617 | 2/1983 | Zamboni | 172/815 X |
| 4,403,432 | 9/1983 | Biance . | |
| 4,439,939 | 4/1984 | Blau . | |
| 4,479,312 | 10/1984 | Turgeon . | |
| 4,707,936 | 11/1987 | Steinhoff . | |
| 4,723,609 | 2/1988 | Curtis | 172/815 |
| 4,741,116 | 5/1988 | Engle et al. . | |
| 4,907,357 | 3/1990 | Lilienthal . | |
| 4,962,600 | 10/1990 | Zellaha et al. . | |
| 5,046,271 | 9/1991 | Daniels . | |
| 5,058,295 | 10/1991 | Holland . | |
| 5,241,763 | 9/1993 | Dynan | 37/407 |
| 5,265,355 | 11/1993 | Daniels . | |
| 5,285,588 | 2/1994 | Niemela et al. . | |
| 5,431,528 | 7/1995 | Jenkins et al. | 37/468 X |

FOREIGN PATENT DOCUMENTS

| | | | |
|---|---|---|---|
| 27 10 320 | 9/1978 | Germany . | |
| 2710320 | 9/1978 | Germany | 172/815 |

OTHER PUBLICATIONS

*Hydra–Scoop Snow Plow*, Farm Industry News, vol. 23, No. 7, p. 25 (Jul./Aug. 1990).

*Primary Examiner*—Terry Lee Melius
*Assistant Examiner*—Victor Batson
*Attorney, Agent, or Firm*—Olson & Hierl, Ltd.

[57] ABSTRACT

A snowplow blade assembly is provided wherein the plow blade is provided with pivotable end extensions that are each pivotable through an angle greater than about 175° from a fully extended and retained blade end extending configuration to a fully folded and retained blade length reducing and extension storage configuration. The mid-back region of the blade is joined to a plow support means that is in non-interfering relationship with the pivotable blade end extensions. Manual weight lifting and supporting operations by an operator are completely avoided.

14 Claims, 8 Drawing Sheets

SNOWPLOW WITH PIVOTABLE BLADE END EXTENSIONS

FIELD OF THE INVENTION

This invention relates to snowplows having blades with pivotable end extensions.

BACKGROUND OF THE INVENTION

The width of the blade of a snowplow can raise problems particularly in the handling, transport and storage of the snowplow. For example, variations in roadway width can be troublesome since a blade that extends beyond the edge of a roadway can damage or even shear off shrubbery and other objects. Moreover, a wide blade may not be within legal width limits for road travel.

Snowplow blade end extensions have been proposed; see, for example, Maura U.S. Pat. No. 4,275,514 which discloses telescoping snowplow blade extensions, and Hine et al. U.S. Pat. No. 4,356,645 disclosing hydraulically controlled pivotably and incrementally positionable snowplow blade extensions.

However, such prior art extendable blade assemblies have a number of disadvantages. Thus, the Maura blade and extension assembly not only appears to be structurally weak, but also appears to be sensitive to certain use conditions (such as the possibility of ice formation between telescopically retracted and adjacent surface portions or in channels).

The Hine et al. blade assembly not only appears to be incapable of blade end extension pivoting beyond a limited acute angle, but also appears to require the use of only small moldboard blade curvature angles (since with relatively large moldboard blade curvature angles significant gaps develop between adjacent end portions as the pivot angle increases between the blade end and the adjacent extension end).

So far as now known, a simple, reliable and economical assembly of snowplow blade and associated blade end extensions has not previously existed whereby each of the blade end extensions is either in an extended and locked blade extended position, or in a fully retracted and locked extension storage position. The present invention provides such an assembly.

SUMMARY OF THE INVENTION

More particularly, this invention is directed to a snowplow having a plow blade whose length is adjustable. Thus, the blade is associated at each of its opposite ends with a pivotably movable blade end extension. The end extensions are each pivotable from a fully extended and blade lengthening end position to a folded blade length reducing and extension storage position. The latter position is achieved by pivoting each end extension from the blade extended position about a vertical axis located adjacent each opposed blade end through an angle in excess of about 175°. Latching means for each end extension storage position are provided.

The invention avoids the need for powered blade end extension maneuvering means for pivotal positioning of the blade end extensions. The invention provides a simple, reliable, operator-safe, manually operated, blade associated, end extension pivoting and latching arrangement. Manual weight lifting and/or supporting operations by an operator of the heavy blade and/or the relatively cumbersome blade end extensions are completely avoided. Also, the problem of end extension storage during non-use is entirely overcome.

As the pivoting means, a hinge assembly for each blade end extension is provided which operably cooperates with the blade and with each of the associated opposed blade end extensions. Thus, each of the end extensions is continuously pivotable from a fully blade aligned blade end extension position relative to each respective associated blade end to a full storage position where the back side of each end extension is located in an adjacent spaced, optionally substantially parallel, relationship relative to each end-adjacent portion of the back side of the associated blade.

The assembly is preferably provided with simple, reliable, trouble-free latching means for use at each of the two intended terminal rest positions for each pivotable end extension.

The assembly of snowplow blade and associated pivotable end extensions can be associated with various snowplow connection means. Preferably, however, the assembly is provided with a snowplow connection means which is adapted for connection or disconnection with a support and positioning subassembly that is associated with and located forwardly of a suitable vehicle, such as an earth moving machine, tractor, snow grooming vehicle or the like.

The snowplow connection means is associated with the mid-back region of the blade. The connection means does not interfere with the end extension pivotable movements or with their respective storage configurations. The connection means is preferably rapidly associatable with or dissociatable from the support and positioning means in a simple and reliable manner without any need for manual lifting or supporting operations by an operator. Optionally but preferably, the connector means can incorporate a blade vertical tilt axis and hydraulic means for regulating blade assembly tilt angle relative to this axis. Also optionally but preferably, the connector means can incorporate a shock release arrangement involving blade tilting about a horizontal axis for preventing blade damage should ground adjacent object be struck by an advancing blade assembly.

The vehicular associated support and positioning assembly is preferably associated with a forwardly extending, hydraulically adjustable mount frame that is operated through controls available to the vehicle operator. More preferably, the snowplow connection means is connectable with and disconnectable from the mount frame mainly by movements of the vehicle and of the mount frame without any snowplow manual lifting and/or supporting operations by an operator of the vehicle. Advantageously, the support and positioning means can be conventional and standardized in type and construction, thereby avoiding any need for a specially designed support and positioning means for use with the snowplow of this invention.

The inventive snowplow assembly is simple, versatile, reliable, rugged and economical. The end extension pivoting is preferably carried out with the assembly preferably somewhat elevated above ground level with only manual guidance and without any requirement for fluidic (i.e, hydraulic) cylinders or the like.

Latching of each end extension relative to the associated blade in each of the extended position and the storage position is preferably achieved by mere pin insertion.

Other and further objects, aims, purposes, features, advantages, embodiments, applications and the like will be apparent to those skilled in the art from the present specification, accompanying drawings and appended claims.

DETAILED DESCRIPTION

Figure 6:
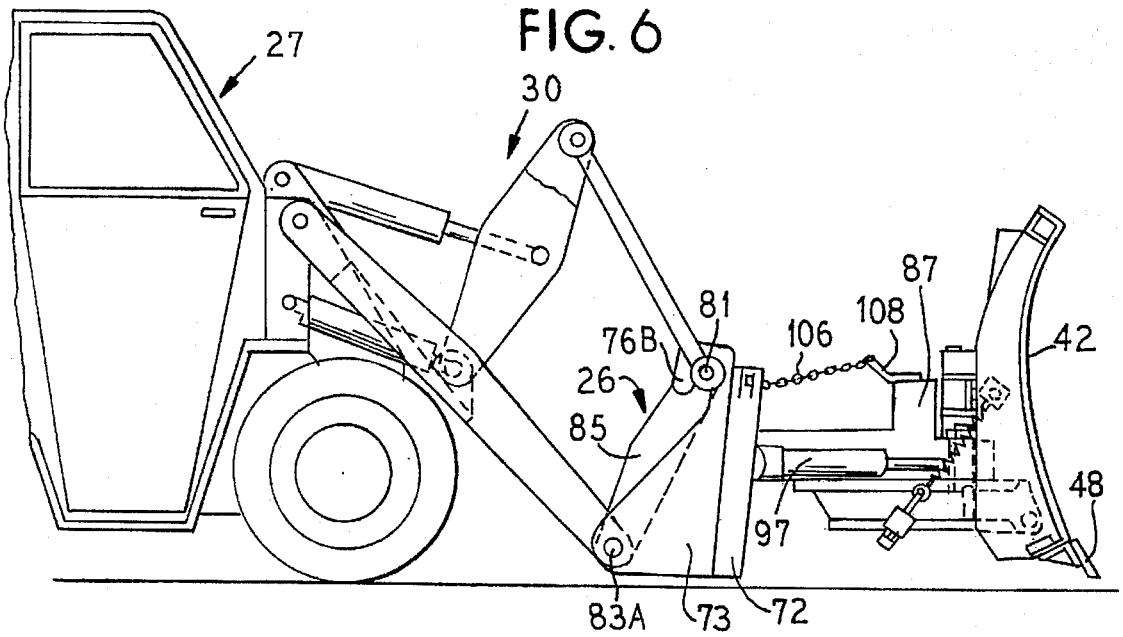
FIG. 6 is a view similar to FIG. 5, but with the mount frame still further advanced and elevated to a position where the snowplow of FIG. 1 is elevated above ground level with grappling hook pivot pins in place so that the snowplow is adapted for usage in association with the vehicle.
Figure 7:
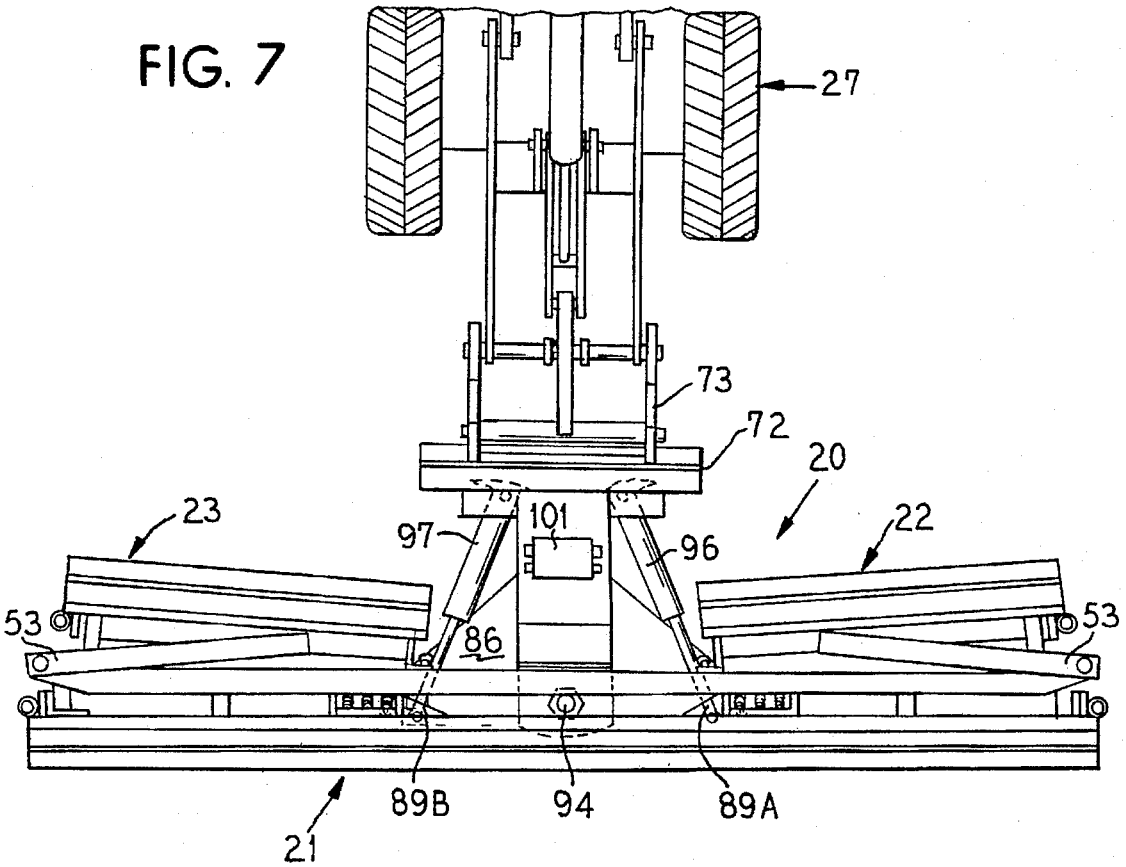
FIG. 7 is a plan view of the apparatus of FIG. 6, but showing both of the pivotably associated blade end extensions of the snowplow of FIG. 1 after pivotal movement thereof into their respective fully folded and latched storage positions.
Figure 8:
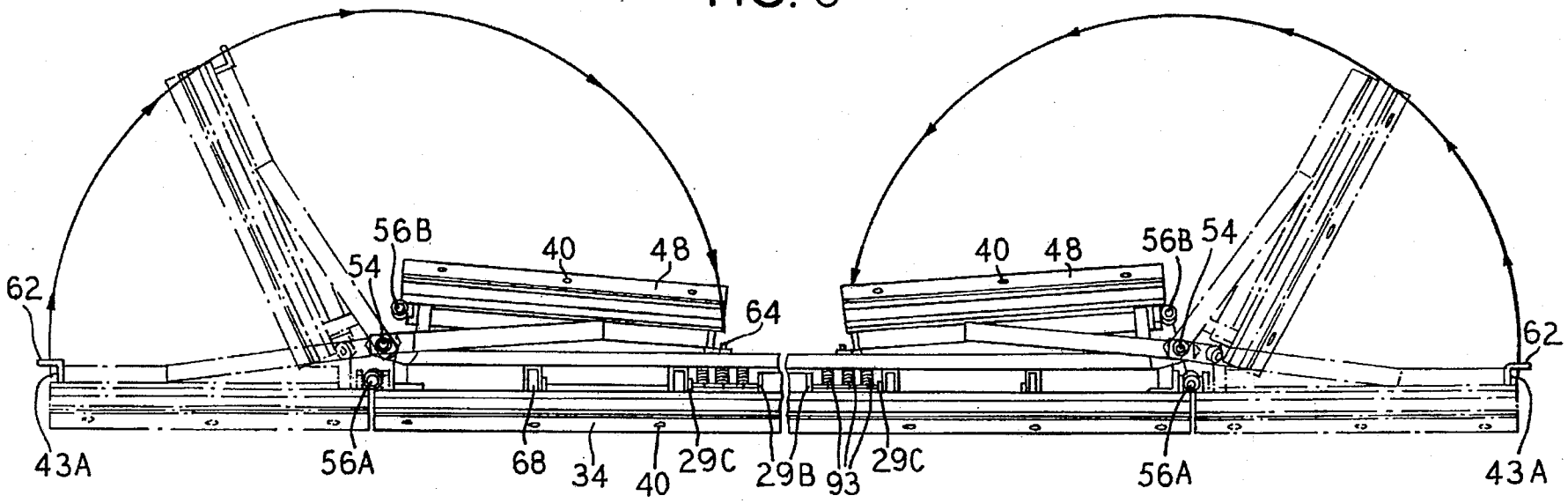
FIG. 8 is a fragmentary enlarged detailed view similar to FIG. 7, but showing structural details and (in phantom) illustrative progressive positions of each of the blade end extensions of the snowplow of FIG. 1 as they pivotably advance from their functional fully extended configurations to their respective fully folded storage configurations.
Figure 9:
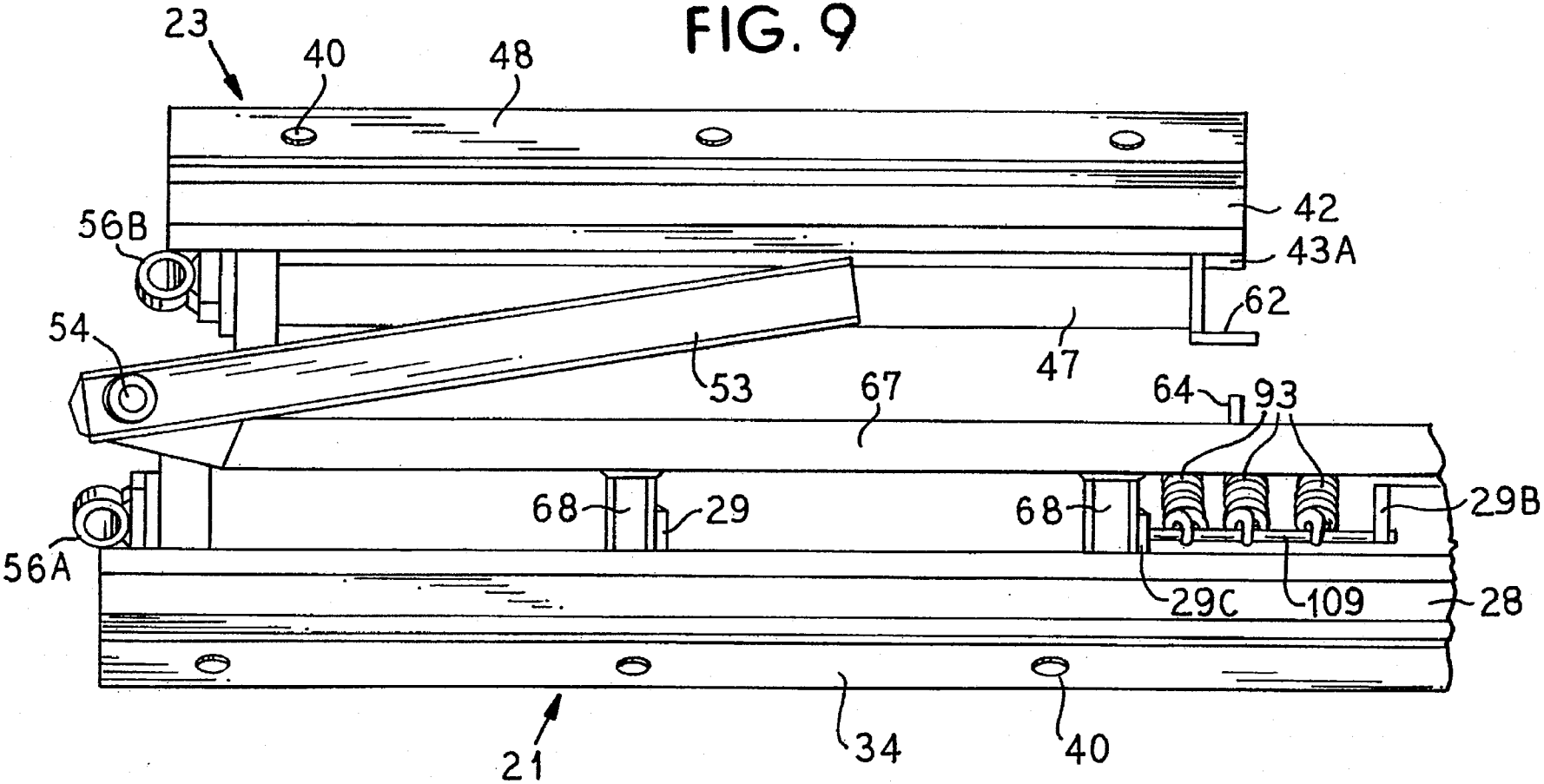
FIG. 9 is a fragmentary further enlarged detailed view similar to FIG. 8, but showing structural details of the right (relative to the vehicle operator whose vehicle is functionally associated with the inventure snowplow embodiment) blade end extension after this extension has been pivoted about 180° from its fully open and extended position (but has not been fully pivoted to its storage position)
Figure 10:
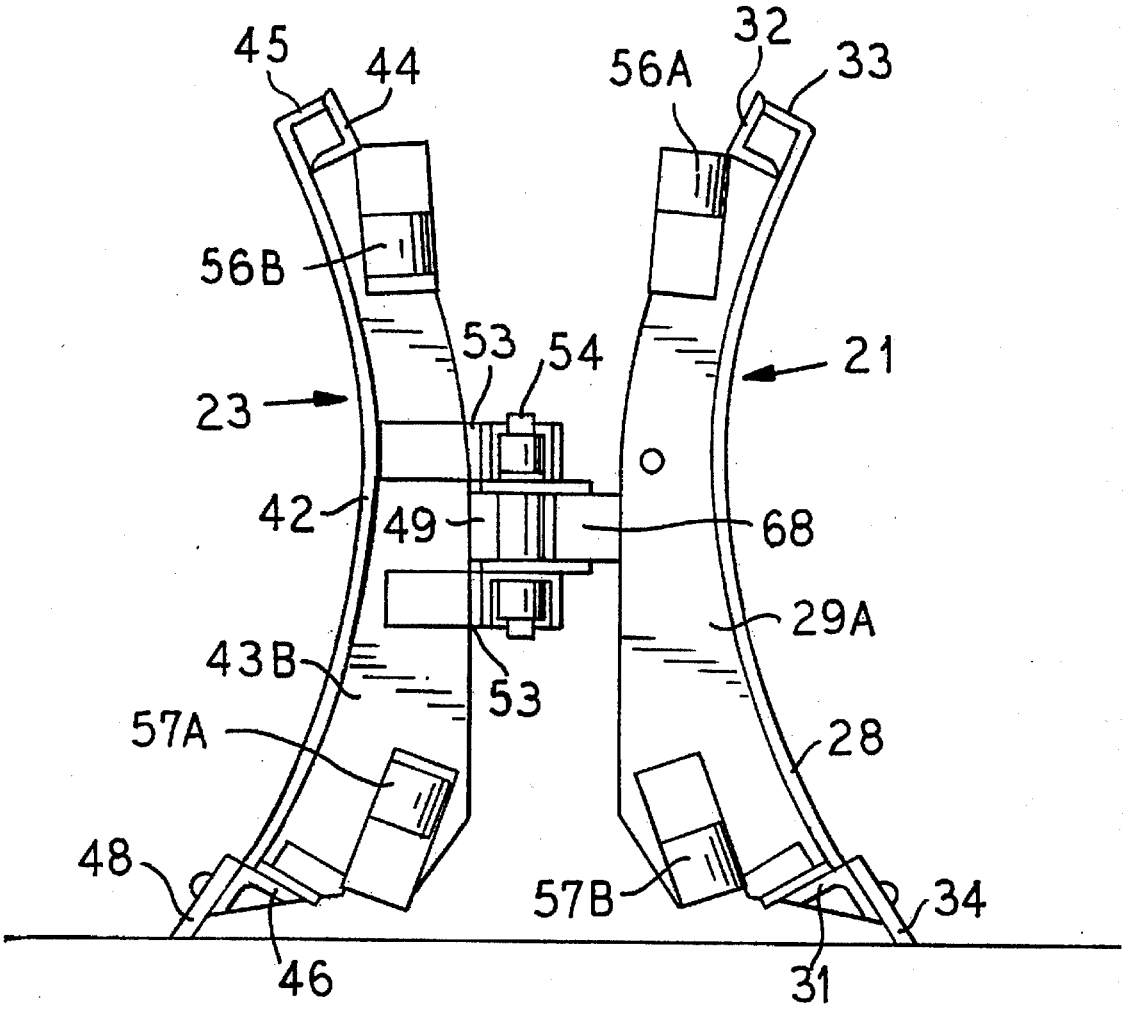
FIG. 10 is an end elevational view of the configuration shown in FIG. 9 where the right blade end extension has been pivoted 180° from its fully open position.

Referring to the drawings, FIGS. 1–11 show an embodiment 20 of the inventive snowplow having a blade structure 21 that is equipped at each of its opposite ends with a pivotable blade end extension 22 and 23. The mid-back region of blade structure 21 is provided with a snowplow connection subassembly 24 that is rearwardly connectable with (and disconnectable from) a conventional, generally forwardly extending, hydraulically adjustable mount frame 26 of a support and positioning subassembly 30 that is itself functionally associated with a conventional vehicle, such as earth moving vehicle or front end loader 27 (see FIGS. 4–7). The blade end extensions 22 and 23 in FIGS. 1–6 are shown in their respective fully extended configurations (or working positions), and in FIGS. 7 and 8 are shown in their respective fully folded storage configurations (or storage positions).

Blade 21 can be variously constructed, as those skilled in the art will appreciate. Typically, blade 21 is elongated and is longitudinally curved so as to present relative to its forward or front face a concavely curved smooth moldboard. Here, blade 21 conveniently is comprised of a sheet metal panel 28 (preferably comprised of steel or a non-rusting ferrous alloy sheeting) which extends substantially continuously on the front face of blade 21 and which is supported and maintained in the desired indicated longitudinally curved configuration by a plurality of longitudinally spaced, vertically oriented, concavely curved ribs 29 that can be variously configured and are preferably formed, for example, of plate steel, formed sheet steel, or the like.

Figure 1:
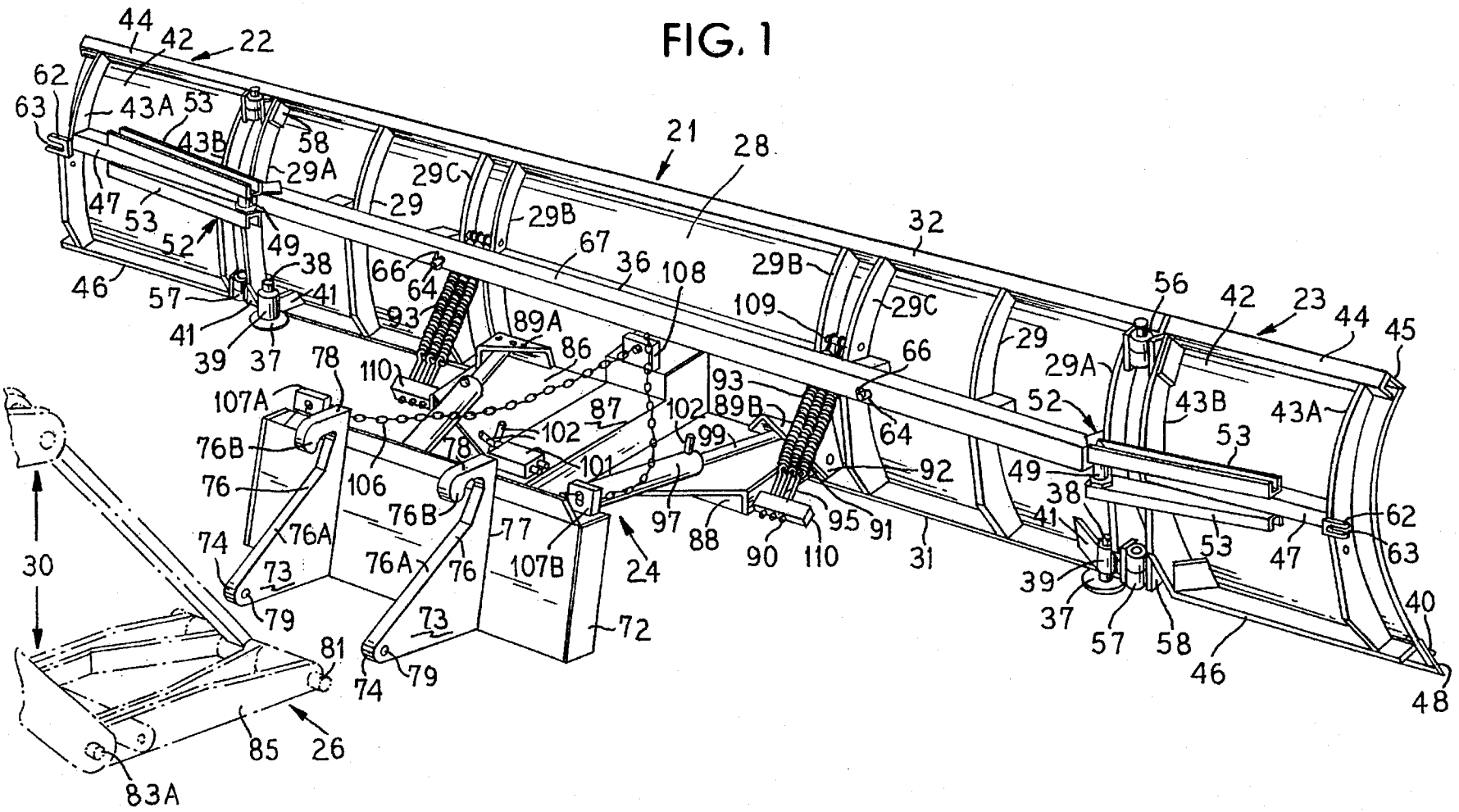
FIG. 1 is a perspective view showing the back side of one embodiment of the inventive snowplow with each of the pivotably associated blade end extensions being shown in their respective fully extended and latched positions, this FIGURE showing the snowplow connection subsssembly in position for functional association with a mount frame of the support, lift positioning and transport subassembly of a front end loader vehicle (complete vehicle not shown)
Figure 2:
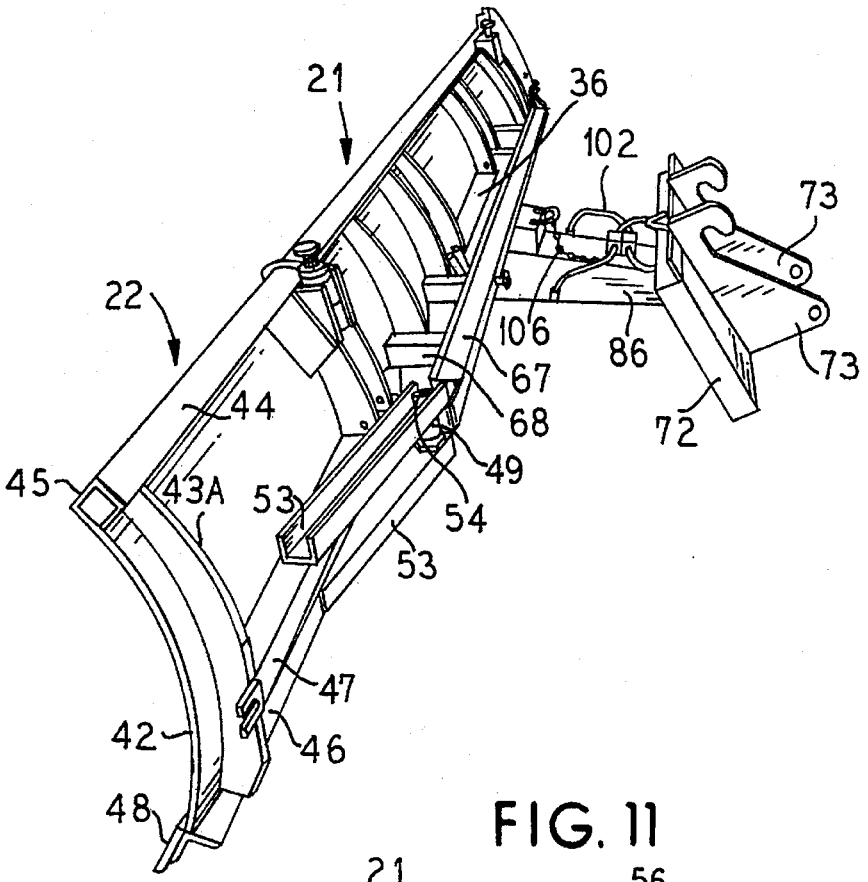
FIG. 2 is another perspective view of the back side of the snowplow of FIG. 1 taken from an opposite side, this FIGURE showing the bracing and supporting structure of the snowplow.
Figure 11:
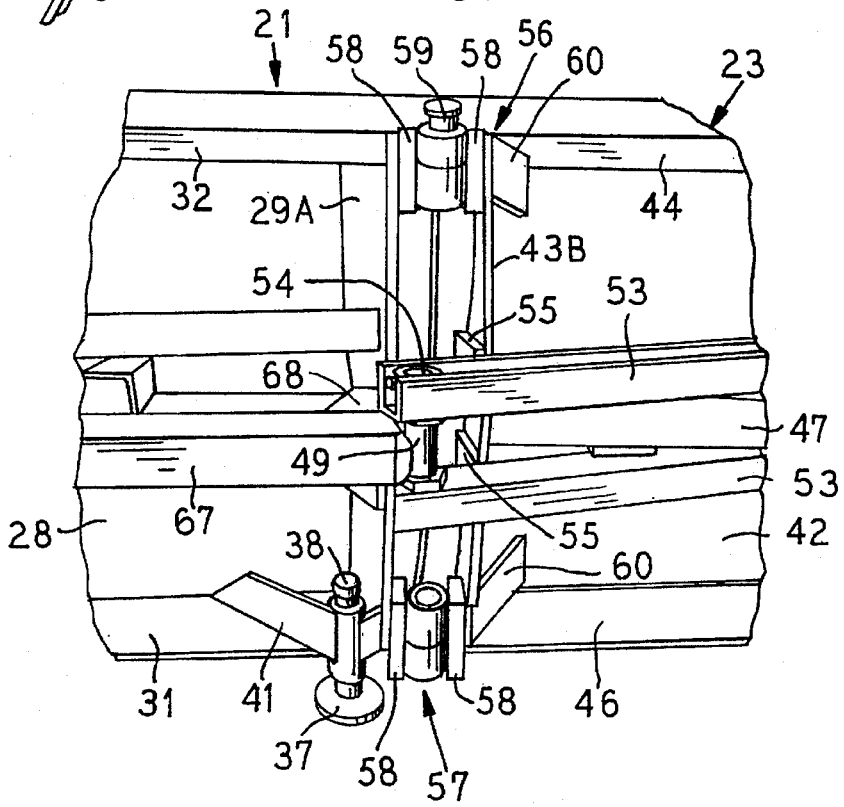
FIG. 11 is a fragmentary back side elevational view of the hinge region of the right blade end extension of the snowplow embodiment of FIG. 1 showing structure details of the hinge assembly for such blade and extension and of the locking pin arrangement.

In blade 21, respective individual rib 29 bottom ends are mounted to spaced locations along a longitudinally extending bottom spar 31, and respective rib 29 top ends are mounted to spaced locations along a longitudinally extending top spar 32. Spars 31 and 32 are in spaced, parallel relationship to each other and can be comprised of stock steel such as angle iron or the like. Midway between and parallel to spars 31 and 32 is a third or support spar 36 of lengths that extend between the spaced ribs 29. Preferably spar 36 extends between the adjacent central pair of ribs 29B (as shown in FIG. 1) and which can, if desired, also extend between other adjacent pairs of ribs 29. However, on the out side of each rib 29B, there is positioned a relatively closely spaced adjacent rib 29C. Each adjacent pair of ribs 29B and 29C is thus suitable, if desired, for holding there between the respective top anchors of 109 of biasing spring sets 93 (as described below). A present preference is no provide no spar 36 between each adjacent pair or ribs 29B and 29C. The spar 36 can be variously formed of stock steel, such as channel iron or the like.

Figure 3:
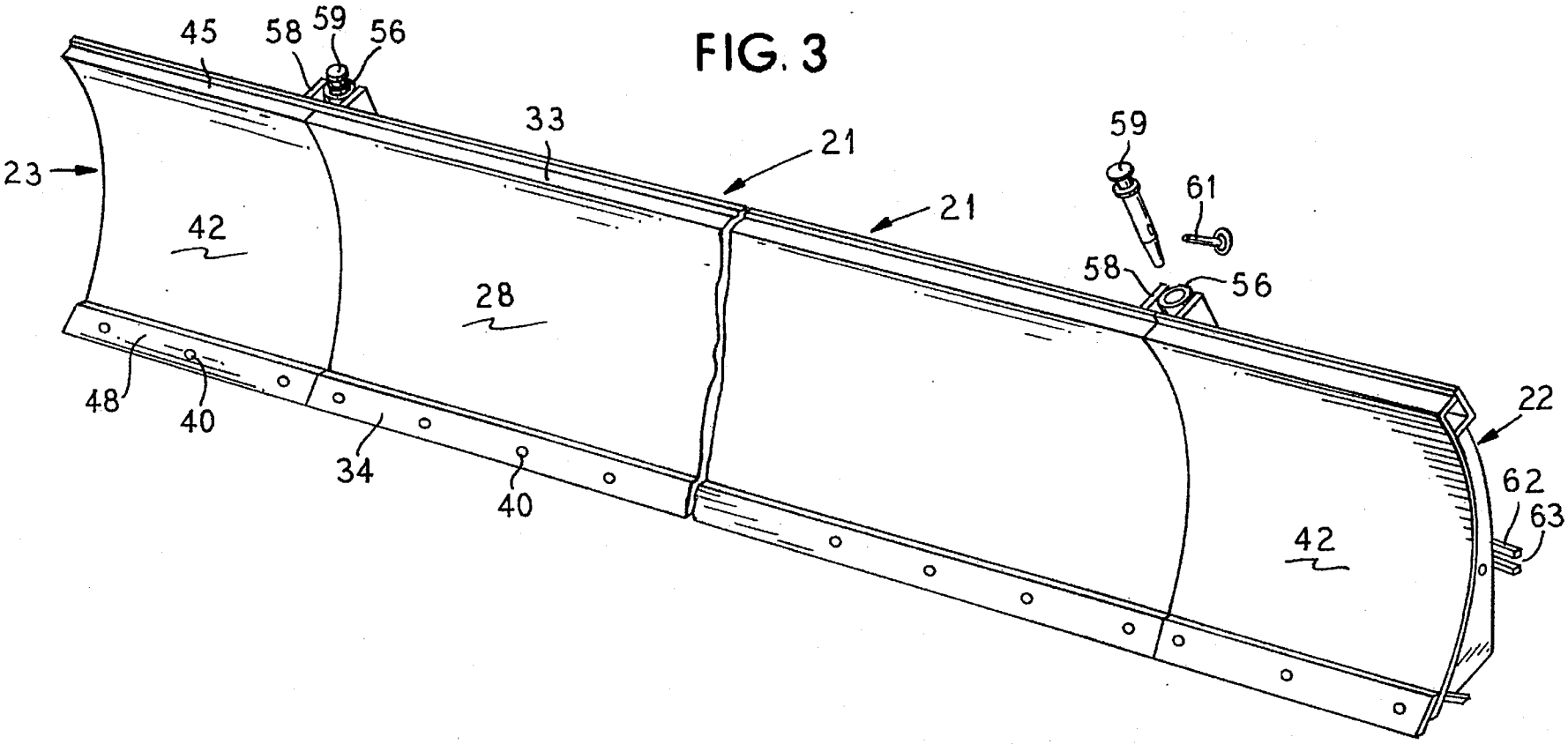
FIG. 3 is a perspective view showing the front side of the snowplow of FIG. 1 with the retaining pin of the left (relative to the vehicle operator) blade end extension being shown in an exploded configuration.

For snow shedding and structural integrity purposes, the longitudinal top edge of panel 28 is preferably formed into a back-turned flange 33 (see, for example, FIG. 3) while the longitudinal bottom edge of panel 28 is in contacting relationship with top edge portions of a replaceable road-adjacent elongated blade member 34 (as shown for example in FIG. 3). Blade member 34 is comprised of steel or the like, is conveniently connected to, and supported by, the bottom spar 31 with nut and bolt assemblies 40 or the like, and is replaceable (when worn or the like).

The snowplow frame structure of blade 21 thus defined by the spars 31, 32, 36 and the ribs 29 can be secured together by weldments, rivets, or the like (not shown). The panel 28 and also blade member 34 can be mounted to this frame by countersunk machine screws, rivets or the like (not shown).

To support lower edge portions of blade 21 in an upright and contacting relationship with an underlying road (road not shown in FIG. 1, but indicated in FIGS. 4–6), a circular shoe or pad 37 comprised of steel or the like is provided for blade 21 adjacent each opposite end region of the bottom spar 31. Each shoe 37 is mounted centrally to a stub shaft 38 that is slidably received in a vertically oriented sleeve 39 which is welded or the like to an exposed rear edge region of spar 31 and that is preferably also braced by welded braces 41 (conveniently two braces 41 per sleeve 39). A retainer means, such as a cotter pin or the like (not shown) extending through shaft 38, conveniently retains the shaft 38 in association with sleeve 39.

Each blade end extension 22 and 23 is like blade 21 similarly comprised of a face panel 42, a pair of longitudinally spaced curved ribs 43A and 43B, a top spar 44, a bottom spar 46, and a mid-region support spar 47 that is here illustratively preferably a cross-sectionally square tubular steel member. The longitudinal top edge of panel 42 is preferably formed into a back-turned flange 45. Each blade end extension 22 and 23 is, like blade 21, similarly provided and associated with a replaceable, road-adjacent blade member 48 with nut and bolt assemblies 40.

A gate-type hinge assembly 52 is provided for the pivotal movement of each blade end extension 22 and 23. Longitudinally across the back of the blade 21 in transversely backwardly spaced, parallel relationship to the mid-spar 36 a longitudinally extending support bar 67 is positioned. Bar 67 is supported and held by a plurality of support extensions 68 that transversely extend between ribs 29 and bar 67, the extensions 68 being conveniently welded to adjoining portions of the ribs 29 and the bar 67 (see, for example, FIG. 2). Bar 67 is preferably comprised of a cross-sectionally square or rectangular steel tube, or otherwise, if desired. Each of the opposite ends of the bar 67 has welded thereto a sleeve 49 whose axis extends vertically. Bracing means for each sleeve 49 can additionally be employed if desired (not generally detailed). Each sleeve 49 can be transversely backwardly (relative to blade 21) offset from bar 67, if desired, as shown illustratively in FIG. 9, for example, by brace members.

Various hinge arm arrangements can be employed. Here, illustratively, a pair of hinge arms 53 is provided for each blade end extension 22 and 23. Each arm 53 is conveniently comprised of channel iron or the like. One end and its end adjacent portions of the main or back outside face of each arm 53 are joined by welding or the like to a different portion of the respective upper and lower edges of each mid spar 47 of each one of the blade end extensions 22 and 23. The members of each pair of arms 53 thus angularly extend in spaced, parallel relationship to each other. Bracing means for each arm 53 can additionally be employed, if desired, such as braces 55 which extend between rib 43B and each arm 53 (see, for example, FIG. 11). The length of each arm pair 53 and their common angle of extension is such that the extended ends of each arm pair 53 overlie in adjacent relationship a different respective opposite end of one sleeve 49. A broad region of support for each extension 22 and 23 by its associated arm 53 is thus provided. The combination of bar 67 and arm pairs 53 makes possible a hinge assembly which is not only strong, but also compensates for the curvature of the blade 21 and its associated extensions 22 and 23.

Each arm pair 53 thus terminates in adjacent relationship to a terminal rib 43B of an extension 22 or 23 and to a terminal rib 29B of blade 21.

Each hinge arm pair 53 is thus aligned with opposite end of a different sleeve 49. Each hinge arm 53 is provided with a hole in its main face that is aligned with the channel in the adjacent sleeve 49. Thus, when a retaining pintle 54 (see FIG. 11) is extended through the members of each arm pair 53 and each adjacent sleeve 49, the gate hinge assembly 52 is completed. Each pintle 54 is preferably provided with retaining means.

Thus, when the snowplow 20 is slightly elevated above ground level (by the operator vehicle 27 as described below), starting from its blade extended position (see FIG. 1, for example), each blade end extension 22 and 23 is continuously and unobstructedly pivotable about an axis defined by the center of each pintle 54 through an angle of at least about 175°. This angle can actually be somewhat greater than 180° as when an extension 22 or 23 is in its storage configuration (see FIGS. 7 and 8). Thus, each blade end extension 22 and 23 is pivotably and continuously movable from its blade extended position (see FIG. 1) to its respective storage position, such as illustratively shown, for example, in FIGS. 7 and 8. When in its storage position, each blade end extension 22 and 23 is located so as to extend along a different respective back side end adjacent portion of blade 21. Thus, in this storage position, the respective back face of each of the blade end extension 22 and 23 extends in adjacent relationship to the adjoining end adjacent portion of the back face of the blade 21 and has been pivoted through an angle somewhat greater than 180° relative to the fully extended position.

Latch means is provided for retaining each of the blade end extensions 22 and 23 in its respective blade extended position and in its blade storage position, whichever respective one of such positions each blade end extension 22 and 23 happens to be occupying. Various retaining (latch) means can be employed, but latch means that incorporate reversibly insertable or positionably retaining pin means are presently preferred.

Thus, to retain each blade end extension 22 and 23 in its blade extended configuration (see FIG. 1, for example), a present preference is to employ (as shown) at least one and preferably two retention ring and pin arrangements per blade end extension. Here, illustratively, two pairs of generally vertically aligned ring member pairs 56 and 57 respectively are preferably provided at the Upper and lower areas of each end of blade 21 (four pairs in all) adjacent each extension 22 and 23. Each pair 56 and 57 is positioned so that each member of each ring member pair 56 and 57 is generally coaxially aligned with the other member when each blade extension 22 and 23 is in its blade extended position at its respective associated opposite end of blade 21. An upper ring member pair 56 is located adjacent to top spars 32 and 44 and between the end adjacent ribs 29A and 43B. Braces 60 are also preferably employed for mounting by welding or the like each pair 56 and 57. A lower ring member pair 57 is located adjacent to bottom spars 31 and 46 and between the end adjacent ribs 29A and 43B. The upper ring member pairs 56 (comprised of ring members 56A and 56B) are preferably oriented so to have a common vertically oriented axis while the lower ring member pairs 57 (comprised of ring members 57A and 57B are preferably oriented so as to have a common inclined axis when viewed in end elevation (see FIG. 10, for example).

For support and positioning purposes, each ring member pair 56 and 57 is provided with, and is located between, and is fastened by welding or the like to, individual members of a plate pair 58 (four plate pairs 58 in all). One member of each plate pair 58 is fixed to one terminal rib 29A and the other member of each plate pair is fixed to one terminal rib 43B. Ribs 29A and 43B are arranged to be in longitudinally spaced parallel relationship to one another. In each ring member pair 56 and 57, one ring member is fixed to one member of each plate pair 58, and the other member of that ring member pair is fixed to the second member of each plate pair 58; hence, one ring member of each ring member pair 56 and 57 is fixed to blade 21 while the other is fixed to one blade end extension 22 or 23 (as the case may be). The respective members of each ring member pair 56 and 57 are generally positioned to be vertically adjacent and coaxially aligned relative to each other when each blade end extension is in its open (or working) position. In such blade extended position, the aligned ring members of each pair 56 and 57 are each adapted for association with a slidably associatable retaining pin 59 (see FIG. 11). It is presently preferred to provide each pin 59 is with a removable locking pin 61 (see FIG. 3) for pin 59 retention purposes when each blade end extension 22 and 23 is in its blade extended configuration (such as shown in FIG. 1).

When blade end extensions 22 and 23 are in their blade extended positions relative to blade 21, the combination of the ring member pairs 56 and 57 and their associated respective pins 59 function to rigidify, strengthen and support the resulting assembly as is desirable when plowing snow.

To retain each blade end extension 22 and 23 in its blade extension storage configuration (see the illustration in FIGS. 7 and 8, for example), a present preference is to employ a stub shaft and retaining pin arrangement. The outside end rib 43A of each blade end extension 22 and 23 is provided (by welding or the like) with an outwardly extending plate engagement tab 62 which is preferably provided with a longitudinally elongated, open ended notch 63 (see, for example, FIG. 1). Aligned with the notch 63 of each tab 62 when each of the blade end extensions 22 and 23 is pivoted into its storage configuration is a stub shaft 64 whose inner end is butt welded or the like to bar 67 so as to cause shaft 64 to transversely project rearwardly and perpendicularly therefrom. When shaft 64 projects through notch 63, a retaining pin 66 can be associated with shaft 64 to retain tab 62 in association with shaft 64.

The snowplow connection subassembly 24 can be variously constructed. The interrelationship between this connection subassembly 24 and the combination of blade 21 with the blade end extensions 22 and 23 and their latch members (such as described above) is such that this connection subassembly 24 is located on the back side of blade 21 so as to be longitudinally midway between each of the blade extensions 22 and 23. Thus, the connection subassembly 24 is in non-interfering relationship with the extensions 22 and 23 both when the extensions 22 and 23 are in their respective storage configurations (or positions), and when the extensions 22 and 23 are pivotably moving towards or away from these storage configurations. The connection subassembly 24 is thus characteristically connected to a mid-region of each back of blade 21.

One presently preferred embodiment of a snowplow connection subassembly 24 is employed in the snowplow 20 although other arrangements can be used.

Here, connection subassembly 24 employs a push frame 86 comprised of heavy gauge formed plate steel or the like. The longitudinal width and the transverse length of the push frame 86 are such that the frame 86 is in non-interfering relationship with the end extensions 22 and 23. Frame 86 includes a transversely extending central column 87 with a raised forward portion and with a medial, longitudinally extending cross brace 88. A pair of brackets 89 are provided which are similarly comprised. Each bracket 89A and 89B is fixed to and supported by a different rib 29B and spar 31 or otherwise. Opposite forward portions of side flanges 91 are secured to frame 86 by welding or the like. Alternatively, flanges 91 can be part of a box section associated with frame 86, if desired. The longitudinally spaced flanges 91 are preferably nestably received between longitudinally spaced vertical portions of the respective brackets 89. Each flange 91 is pivotably associated with its adjacent bracket 89 by a different one of a pair of generally horizontally oriented, generally coaxial support shafts 92 (the end of one support shaft 92 being shown in FIG. 1). Each shaft 92 extends between a different one of a pair of components comprising a flange 91 and an outside vertical portion of a bracket 89. Each bracket 89 is thus pivotable relative to shaft 92 and flange 91. Thus, while the push frame 86 is generally horizontally oriented (as shown for example in FIG. 1), the assembly of blade 21 with the associated extensions 22 and 23 (whether or not these extensions are in their extended or storage configurations) is pivotable relative thereto about an axis corresponding to the axis of shafts 92. Such pivotability is desirable as a means for avoiding damage to the blade 21 or the extensions 22 and 23 when and if the blade 21 or an extension 22 and 23 strikes an object on a roadway that is being plowed with snowplow 20 to remove accumulated snow. Thus, when such an object is struck, the blades 34 and 48 (when the extensions 22 and 23 are in their fully extended configuration) swing transversely rearwardly while the top spars 32 and 44 swing transversely forwardly.

To maintain the blade 21 and associated extensions 22 and 23 biased in a normally upright configuration, two sets 93 of biasing tension springs are provided. Each spring set 93 illustratively is here comprised of three coiled steel springs or the like. Each set is mounted under tension between a top anchor 109 and a bottom anchor 110. Each top anchor 109 is mounted between a different pair of ribs 29B and 29C preferably just above bar 67 and spar 36. Each bottom anchor 110 is mounted to extend longitudinally outwardly from a different side flange 91 in opposed relationship.

Preferably, and as shown (see FIG. 1 for example), each tension spring of each spring set 93 is terminally associated with a rod 95. By adjusting the effective length of each rod 95 through turning a nut 90 that threadably engages the rod 95 end after it has been extended through the anchor 110, the tension of the associated spring is adjustable, as desired.

Tilting of, for example, blade 21 about the horizontal axis defined by shafts 92 causes the spring tension force exerted by the spring sets 93 to urge the blade 21 back into its normal upright position (as illustrated in FIG. 1). A limiting stop means that sets this normal position can be variously achieved; for example, the stop means can be provided by abutting engagement between spar 36 and the forward upper portion of column 87. Obstruction relieving pivoting action for a snowplow blade about a horizontal pivot axis has heretofore been known, but such an action has never previously been employed with a snowplow blade having pivotable end extensions, such as here provided, so far as now known.

The rearward terminal region of push frame 86 is joined to a preferably rectangularly configured reference plate 72 comprised of steel plate or the like that extends longitudinally across the terminal rear end of the push frame 86. As shown in, for example, FIG. 2, the reference plate 72 is typically somewhat inclined as when the snowplow 20 is not in use so that its top edge is displaced forwardly of its bottom edge, but plate 72 can be generally vertically oriented if desired.

In snowplow 20, the reference plate 72 is preferably pivotably but conventionally joined to the push frame 86 for allowing pivotal movements of frame 86 relative to reference plate 72 about a horizontal axis so that in use plow 21 can ascend or descend as on sloping ground (since, in use, plow 21 and extension 22 and 23 lead the vehicle 27). To provide a stop means for limiting the extent of downward horizontal axis pivoting of the plow 21 relative to the plate 72, a chain 106 is provided. The chain 106, as shown for example in FIG. 1, extends in connected relationship from a bracket 107A that is welded or the like on the upper left hand corner (relative to the operator of vehicle 27) of the plate 72 to a bracket 108 that is welded or the like on the top forward center portion of the central column 87 and to a bracket 107B that is welded or the like on the upper right hand corner of the plate 72.

Figure 4:
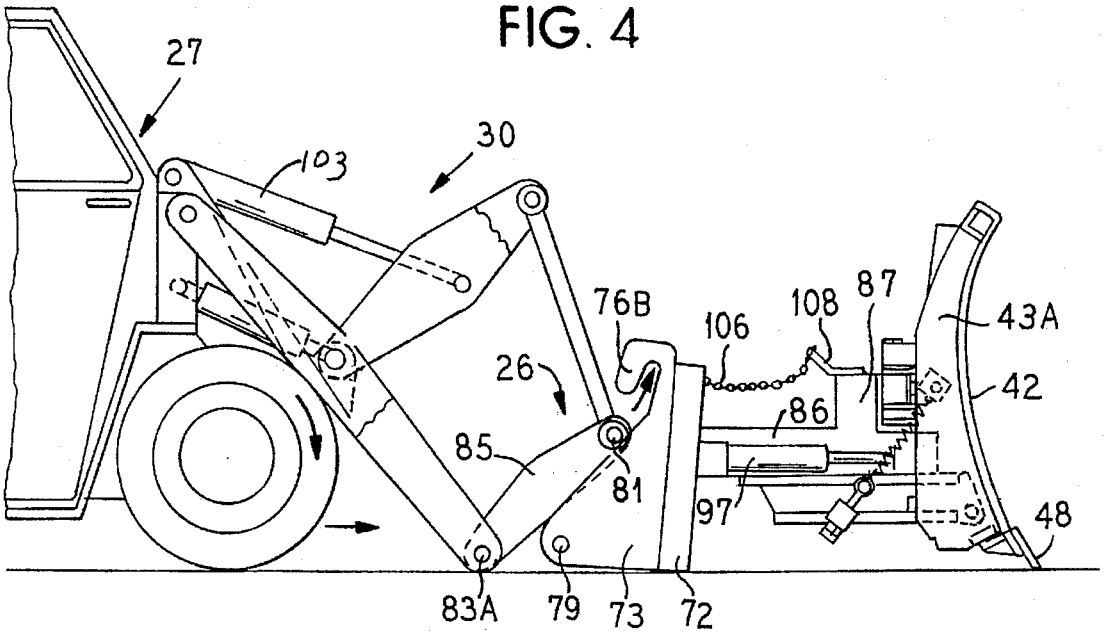
FIG. 4 is a partly schematic side elevational view of the snowplow of FIG. 1, but with the front end loader advancing and moving the mount frame of its support, lift, positioning and transport subassembly into engagement with the snowplow connection subassembly.
Figure 5:
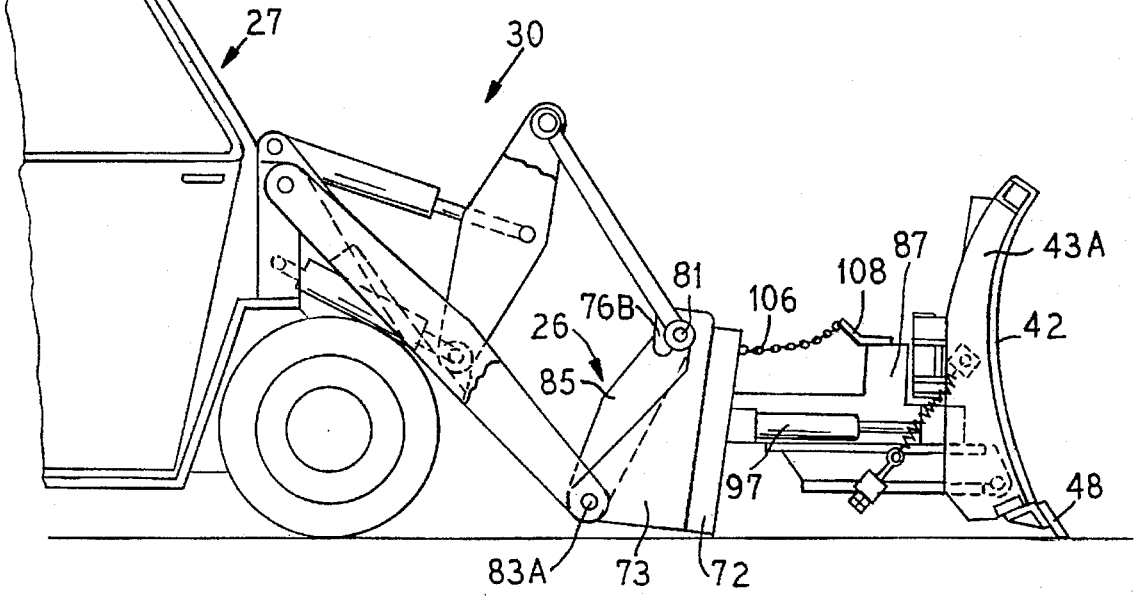
FIG. 5 is a view similar to FIG. 4, but with the mount frame further advanced and elevated to a position of full engagement with the mounting subassembly of the FIG. 1 snowplow.

When the snowplow 20 is generally in a resting configuration, such as shown, for example, in FIG. 4 where the plate 72 and the plow 21 (and extensions 22 and 23) are ground engaged, the chain 106 is in a limp configuration. However, when the plow 21 (and extensions 22 and 23) is supported in an above ground elevated condition by the support and positioning assembly 30, the chain 106 becomes taught since it is limiting the downward extent of pivoting about such horizontal axis of plow 21 (and extensions 22 and 23) relative to plate 72. The forward central terminal region of push frame 86 is pivotably associated with a normally vertically oriented shaft 94 (see FIG. 7) that is illustratively rigidly supported by and connected to spar 31 (connection means not detailed).

Thus, with the push frame 86 in a stable orientation, the blade 21 (and associated extensions 22 and 23) is pivotably movable from side to side about the axis of the shaft 94. The relationship between shaft 94 and push frame 86 is preferably such that tilting of plow 21 about the horizontal tilt axis defined by shafts 92 is independent of the pivoting of plow 21 about the vertical axis defined by shaft 94. The relationship between shaft 94 and push frame 86 is preferably such that pivoting of plow 21 about the vertical axis of the shaft 94 is typically accomplished with the push frame 86 being generally horizontally oriented. Preferably, there is no interference with the tiltability of plow 21 about the horizontal axis defined by shafts 92 during pivoting about the vertical axis of shaft 94. Preferably, pivotability of plow 21 about the vertical axis of shaft 94 extends through an angle of at least about 25° on either side of a (hypothethical) transverse center line of the push frame 86 which line passes through the axis of shaft 94.

To guide and control the pivotal movements of, and to achieve a chosen fixed position for, the plow 21 (and the associated extensions 22 and 23) relative to the push frame 86 and the reference plate 72, a pair of conventional hydraulic double acting cylinders 96 and 97 are provided which are oriented in spaced relationship to one another in a common horizontal plane that is substantially aligned in parallel relationship with push frame 86. The forward end of the extendable and retractable rod 98 of cylinder 96 is pivotably connected to the left bracket 89A while the rear end of cylinder 96 is pivotably connected to a post on the left rearward side (relative to the driver of vehicle 27) of push frame 86 (see FIG. 7). The forward end of the extendable and retractable rod 99 of cylinder 97 is pivotably connected to a post on the right bracket 89B while the rear end of cylinder 97 is pivotably connected to the right rearward side (relative to the driver of vehicle 27), of push frame 86 (see FIG. 7). The fluidic pressure on the rod-associated piston (not detailed) in each of the cylinders 96 and 97, and the resulting extended position of each rod 98 and 99, respectively, is regulated by the conventional hydraulic fluid distribution valve 101 with which each of the cylinders 96 and 97 is conventionally connected by two flexible conduits 102 (which are not fully detailed). Valve 101 functions so that extension of one rod, such as rod 98 causes retraction of the other rod, such as rod 99. The respective extended positions of each rod 98 and 99, and, consequently, the pivot position of the blade 21 (and its extensions 22 and 23) is conveniently remotely controlled preferably by the selected position of a single control lever set by the operator of vehicle 27. A valve set switch can be provided for operator use in fixing the pivot angle at a given blade position after pivoting to a desired blade position.

In addition to such operator control, the valve 101 is preferably provided with a pair of conventional pressure transducers (not detailed), each one of which is responsive to (that is, senses) sudden fluidic compression force increases in an individual cylinder 96 or 97. Such an increase in fluidic force is caused when an obstruction (such as a post) is struck by either the right or left side of the blade 21 (or of on extension 22 and 23 that is fully extended in an operative configuration relative to blade 21). When such a fluidic pressure increase exceeds a set point pressure level, the valve 101 opens (ports) for the affected cylinder and constructs for the other cylinder, thereby resulting in immediate fluid pressure release in the affected cylinder and thereby resulting in the backward pivoting of the blade 21 (and extension) on the side thereof that is in contact with the obstruction. Such release and pivoting avoids damage to the impacting blade 21 and/or the impacting extension 22 or 23, as the case may be.

For purposes of pivotability about a vertical axis, one can if desired employ the combination of blade 21 and extensions 22 and 23 with a snowplow connection subassembly that does not employ hydraulic positioning means and that instead employs a manual horizontal pivoting (about a vertical axis) and a mechanical locking arrangement for a blade 21 in a desired angular position; such an arrangement is not detailed herein.

Thus, the extensions 22 and 23 in the indicated combination with blade 21 do not interfere with pivotal blade movements about either a horizontal or a vertical axis.

To minimize manual operations, the rear face of plate 72 is here preferably (and as shown) connected by welding or the like to a pair of symmetrically positioned, longitudinally spaced, parallel, vertically oriented grappling plates 73 comprised of steel or the like. Each plate 73 has a forward edge 77 that is abuttingly engaged by welding or the like with the rear face of the reference plate 72, and a rear edge 76 which is contoured. Thus, rear edge 76, commencing at the bottom rearwardmost corner region 74 of plate 73, progressively extends upwardly and forwardly to define a ramp portion 76A. Ramp portion 76A terminates at its upper end in an overlying, rearwardly opening grappling hook 76B that is defined in the upper rear edge of plate 73 located adjacent to, but beneath, the top edge 78 and that is also laterally adjacent to the forward edge 77. Each plate 73 has defined therethrough adjacent to the bottom of the bottom corner 74 at the beginning of ramp 76A a longitudinally extending aperture 79.

Each of the opposite terminal end regions of the forward, horizontally extending cross bar 81 of mount frame 26 of the conventional (not part of this invention) support and positioning subassembly 30 of the vehicle 27 (see, for example, FIGS. 4–6) is adapted to engage the ramp 76A of each grappling plate 73 as the vehicle 27 advances and as cross bar 81 is elevated by the operator-controlled advance of vehicle 27. The conventional mount frame 26 may have various internal structural arrangements; one arrangement is shown, for example, in FIG. 1 in phantom, and another arrangement is indicated in, for example, FIG. 7. As the vehicle 27 advances from the position shown in FIG. 1, the cross bar 81 slidably advances, engages ramp 76A and moves up each of the ramps 76A as shown, for example, in FIG. 4. This movement continues until the cross bar 81 advances to the top location along rear edge 76 shown in FIG. 5 where each of the cross bar 81 opposed end regions is fully engaged with a different hook 76B. Each grappling plate 73 is then located adjacent to and along the out side of a different cross bar support 85. Each aperture 79 is aligned with a shaft 83A that is here associated with an elbow region of the mount frame 26.

Shaft 83A (see FIGS. 5 and 6) is now manually or hydraulically inserted through the aligned aperture 79, thereby securing the grappling plates 73 and completing a mounting of snowplow 20 to the support and positioning subassembly 30. The hydraulic lines between vehicle 27 and the snowplow 20 are connectable by conventional so-called "quick" connect/disconnect fittings (not shown).

With each of the grappling plates 73 thus connected to the mount frame 26, further advance of the vehicle 27 and further elevation of the mount frame 26 results in the elevation of snowplow 20 into an above-ground position, such as shown in FIG. 6 for example.

When snowplow 20 is being used for plowing snow with the blades 48 and 34 generally ground engaged, the height control hydraulic cylinder of the support and positioning subassembly 30 such as cylinder 103 can in some arrangements be set in a neutral position so that the piston thereof is effectively non-pressurized. With such an arrangement the leading (relative to vehicle 27) plow 21 and the extensions 22 and 23 can ride over a ground surface which is rising (ascending) or falling (descending) relative to the position of the wheels of the following vehicle 27, with the plate 72 being fixed relative to push plate 86, as those skilled in this art will readily appreciate.

The foregoing description makes use of an illustrative embodiment of this invention, and no limitations upon the present invention are to be implied or inferred therefrom.

What is claimed is:

1. In a snowplow of the type having:

(a) an elongated, straight blade means having a smooth longitudinally and concavely curved forward face, opposite ends, a backface, and top and bottom edge portions;

(b) a blade extension means at each said opposite end;

(c) hinge means pivotably connecting each said blade extension means to said blade means for moving each said blade extension means from a blade extension extended position to a blade extension storage position relative to said blade means; and (d) retaining means for retaining each said blade extension means in said blade extension extended position and in said blade extension storage position;

the improvement which comprises:

(A) said hinge means being medially located between said top and bottom edge portions adjacent each said opposite end on said backface;

(B) said retaining means holding each said blade extension means when in said blade extension extended position, said retaining means being located (i) on adjoining respective portions of each of said blade means and respective ones of said blade extension means and also (ii) in adjacent relationship to at least one of said top and said bottom edge portions, whereby said hinge means and said retaining means cooperate to strengthen the association between said blade means and each said blade extension means when each said blade extension means is in said blade extension extended position; and (C) said retaining means comprising (a) ring means at each of said opposite ends and also at each of said inner ends, said respective ring means being aligned with one another when each of said blade extension means is in said blade extension extended position, and (b) pin means insertable into said ring means whereby, when said ring means are so aligned with one another, said pin means is insertable into said ring means thereby to connect together each of said opposite ends with the adjacent one of said inner ends, the relationship between said pin means and said ring means being such that, when said pin means is so inserted into said ring means, said pin means is adjacent to at least one of either said upper edge portions or said lower edge portions.

2. The snowplow of claim 1 wherein said engaging means comprises one pair of said insertable pin means for so connecting together each of said opposite ends with said adjacently positioned one of said inner ends, and a pair of said aligned ring means for each one of said pin means of said pair, whereby, as so connected together, and said pin means is so inserted into said ring means, one pin means of said pair is adjacent to said upper edge portions, and the other pin means of said pair is adjacent to said lower edge portions.

3. The snowplow of claim 2 wherein each said hinge means comprises:

(a) a vertically oriented sleeve member, said sleeve member being located adjacent a different one of each said opposite end and at a mid-location of said blade means backface and each said sleeve member having opposite ends and a channel therethrough;

(b) sleeve support means associated with said sleeve member and with said blade means backface for supporting said sleeve member;

(c) elongated support arm means associated with a different one of each of said blade extension means, said support arm means extending diagonally and longitudinally from association with a backface region of a different one of each said blade extension means and terminating over a least one of said sleeve member opposite ends, and including fastening means for so associating said support arm means with each said blade extension means; and (d) pintle means extending in said sleeve channel and pivotably joining thereto said support arm means;

whereby each one of said blade extension means is pivotably movable from said blade extension extended position thereof to said blade extension storage position thereof.

4. A snowplow comprising:

(a) a snowplow blade means having a smooth forward face, a generally opposed backface, longitudinally opposite ends, upper and lower side edge portions, and a longitudinal concave curvature relative to said forward face;

(b) a pair of blade extension means, each blade extension means having a smooth forward face, a generally opposed backface, longitudinally opposed inner and outer ends, and upper and lower side edge portions, each said blade extension means having said inner end thereof adjacently positioned at a different one of said opposite ends with said outer end thereof projecting outwardly, whereby a blade extension extended position is defined, and, when in said blade extension extended position, each said blade extension means has a longitudinal concave curvature relative to said forward face thereof which generally corresponds to said longitudinal concave curvature of said blade means whereby said blade means is extended at each of said opposite ends by one of said blade extension means;

(c) a pair of hinge means, each one medially interconnecting one of said blade means opposite ends with a different one of said blade extension means inner ends whereby each said blade extension means is continuously pivotably movable by a different one of said so interconnected hinge means through an angle relative to said blade means from said blade extension extended position to a position defining a blade extension storage position wherein said backface of each one of said blade extension means extends generally along and adjacent to a different respective opposite end adjacent portion of said blade means backface;

(d) retaining means for retaining each said blade extension means in said blade extension extended position and in said blade extension storage position, whichever respective one of said positions each said blade extension means occupies, said retaining means for said blade extension extended position including ring means at each of said opposite ends and also at each of said inner ends, said respective ring means being aligned with one another when each of said blade extension means is in said blade extension extended position, and pin means insertable into said ring means whereby, when said ring means are so aligned with one another, said pin means is insertable into said ring means thereby to connect together each of said opposite ends with the adjacent one of said inner ends, and the relationship between said pin means and said ring means is such that, when said pin means is so inserted into said ring means, said pin means is adjacent to at least one of either said upper edge portions or said lower edge portions; and (e) snowplow connection means medially joined to said blade means backface for supporting said blade means, said hinge means, said retaining means and said blade extension means relative to an underlying ground surface, said connection means being in substantially non-interfering relationship relative to each of said blade extension means when in their respective said blade extension storage positions.

5. The snowplow of claim 4 wherein each of said pin means is reversibly insertable.

6. The snowplow of claim 4 wherein said retaining means for each said blade extension extended position comprises one pair of said insertable pin means for so connecting together each of said opposite ends with said adjacently positioned one of said inner ends, and a pair of said aligned ring means for each one of said pin means of said pair, whereby, as so connected together, and said pin means is so inserted into said ring means, one pin means of said pair is adjacent to said upper edge portions, and the other pin means of said pair is adjacent to said lower edge portions.

7. The snowplow of claim 4 wherein each said retaining means for retaining each said blade extension means in said blade extension extended position comprises:

(a) a first pair of ring members for each one of said blade means opposite ends, one ring member of each said first pair of ring members being fixed to a lower side edge back(ace portion of each said opposite end, and the second ring member of each said first pair of ring members being fixed to a lower side edge back(ace portion of each of said inner ends, whereby, in each said first pair of ring members, said one ring member is generally coaxially aligned with said second ring member when each respective said blade extension means is in said blade extension extended position; and (b) first connecting pin means for each said first pair of ring members, each said first connecting pin means being slidably insertable into each of said first pair of ring members when each ring member of said first pair of ring members is so coaxially aligned, thereby to interconnect said one ring member with said second ring member, each said first connecting pin means including retaining means for maintaining said first connecting pin means in said interconnected relationship.

8. The snowplow of claim 7 wherein said retaining means for retaining each said blade extension means in the blade extended position further includes:

(a) a second pair of ring members for each one of said blade means opposite ends, one ring member of each said second pair of ring members being fixed to an upper side edge backface portion of each said opposite end, and the second ring member of each said second pair of ring members being fixed to an upper side edge backface portion of each of said inner ends, whereby, in each said second pair of ring members, said one ring member is generally coaxially aligned with said second ring member when each respective said blade extension means is in said blade extension extended position; and (b) second connecting pin means for each said second pair of ring members, each said second connecting pin means being slidably insertable into each of said second pair of ring members when each ring member of said second pair of ring members is so coaxially aligned, thereby to interconnect said one ring member with said second ring member, each said second connecting pin means including retaining means for maintaining second connecting pin means in said interconnected relationship.

9. The snowplow of claim 4 wherein each said retaining means which so retains each said blade extension means in said blade storage position comprises:

(a) stud means fixed to and projecting from said blade means;

(b) plate means fixed to and projecting from an outer edge of the adjacent one of said blade extension means and having an aperture defined therethrough;

(c) the relationship between said stud means and said plate means being such that said stud means extends through said aperture when said adjacent one of said blade extension means is in said blade storage position; and (d) pin retaining means for maintaining said stud means so extended through said aperture.

10. The snowplow of claim 4 wherein each said hinge means comprises:

(a) a vertically oriented sleeve means, each said sleeve means being located adjacent a different one of each said opposite end and at a mid-location of said blade means backface and each said sleeve means having opposite ends and a channel therethrough;

(b) sleeve support means associated with said blade means backface for supporting each one of said sleeve means;

(c) elongated support arm means associated with each said blade extension means, each said support arm means extending diagonally and longitudinally from association with a backface region of a different one of each said blade extension means and terminating over at least one of said sleeve channel opposite ends, and including fastening means for so associating each said support arm means with each said blade extension means; and (d) pintle means extending in each of said sleeve channels and pivotably joining thereto said support arm means of each opposite end adjacent said blade extension means;

whereby each one of said blade extension means is pivotably movable from said blade extension extended position thereof to said blade extension storage position thereof.

11. The snowplow of claim 10 wherein in each said hinge means said support arm means is generally fastened to a mid-region of said backface of each said blade extension means.

12. The snowplow of claim 10 wherein in each said hinge means said support arm means for each one of said blade extension means comprises a pair of spaced, parallel arms.

13. The snowplow of claim 10 wherein in each said hinge means said sleeve support means includes a single, common elongated bar means which generally longitudinally extends in spaced, adjacent relationship across portions of said blade means backface, and said bar means is held by mounting means joined to portions of said backface.

14. The snowplow of claim 4 wherein said snowplow connection means includes:

(a) a push plate means connected to the midcentral region of said back face;

(b) a vertically oriented reference plate means across the rear of said push plate means; and (c) a pair of grappling plates; each plate being in longitudinally spaced parallel relationship to the other and generally vertically oriented, each plate having a forward edge abuttingly engaged with the rear face of said reference plate means, each plate having a rear edge which has defined therein a progressively upwardly and forwardly extending, inclined ramp that extends from its bottom edge and that terminates in a rearwardly opening grappling hook adjacent its upper edge, and each plate having defined therein adjacent the bottom of said ramp an aperture; whereby the longitudinally oriented cross bar means of a prechosen support and positioning means that is connected to the front end region of a vehicle is slidably advanceable up said ramp of each one of said grappling plates until said cross bar means is engaged with each one of said grappling hooks, and whereby said aperture of each one of said grappling plates is aligned with a hole in a laterally extending cross bar extension arm that is adjacent to each one of said grappling plates after said cross bar extension arm has been so engaged with each one of said grappling hooks.

* * * * *